US005689031A

United States Patent [19]

Berlowitz et al.

[11] Patent Number: 5,689,031

[45] Date of Patent: Nov. 18, 1997

[54] SYNTHETIC DIESEL FUEL AND PROCESS FOR ITS PRODUCTION

[75] Inventors: Paul Joseph Berlowitz, East Windsor; Bruce Randall Cook, Pittstown, both of N.J.; Robert J. Wittenbrink, Baton Rouge, La.

[73] Assignee: Exxon Research & Engineering Company, Florham Park, N.J.

[21] Appl. No.: 544,345

[22] Filed: Oct. 17, 1995

[51] Int. Cl.[6] ..... C07C 5/27

[52] U.S. Cl. ..... 585/734; 585/733; 585/737; 208/27

[58] Field of Search ..... 585/734, 733, 585/737; 208/27

[56] References Cited

U.S. PATENT DOCUMENTS

| | | | |
|---|---|---|---|
| 4,125,566 | 11/1978 | Dink et al. . | |
| 4,568,663 | 2/1986 | Mauldin | 502/325 |
| 4,804,802 | 2/1989 | Evans et al. | 585/734 |
| 4,919,786 | 4/1990 | Hamner et al. | 585/736 |
| 4,943,672 | 7/1990 | Hamner et al. | 585/737 |
| 4,992,159 | 2/1991 | Cody et al. | 585/734 |
| 5,059,299 | 10/1991 | Cody et al. | 585/737 |
| 5,059,741 | 10/1991 | Foley | 585/734 |
| 5,292,989 | 3/1994 | Davis | 585/734 |
| 5,378,348 | 1/1995 | Davis et al. | 208/27 |

FOREIGN PATENT DOCUMENTS

| | | | |
|---|---|---|---|
| 01769 | 6/1992 | WIPO | 585/734 |

*Primary Examiner*—Margaret Medley
*Attorney, Agent, or Firm*—Jay Simon

[57] ABSTRACT

Clean distillate useful as a diesel fuel or diesel blending stock is produced from Fischer-Tropsch wax by separating wax into heavier and lighter fractions; further separating the lighter fraction and hydroisomerizing the heavier fraction and that portion of the light fraction below about 500° F. The isomerized product is blended with the untreated portion of the lighter fraction.

11 Claims, 2 Drawing Sheets

SYNTHETIC DIESEL FUEL AND PROCESS FOR ITS PRODUCTION

FIELD OF THE INVENTION

This invention relates to a distillate material having a high cetane number and useful as a diesel fuel or as a blending stock therefor, as well as the process for preparing the distillate. More particularly, this invention relates to a process for preparing distillate from a Fischer-Tropsch wax.

BACKGROUND OF THE INVENTION

Clean distillates that contain no or nil sulfur, nitrogen, or aromatics, are, or will likely be in great demand as diesel fuel or in blending diesel fuel. Clean distillates having relatively high cetane number are particularly valuable. Typical petroleum derived distillates are not clean, in that they typically contain significant mounts of sulfur, nitrogen, and aromatics, and they have relatively low cetane numbers. Clean distillates can be produced from petroleum based distillates through severe hydrotreating at great expense. Such severe hydrotreating imparts relatively little improvement in cetane number and also adversely impacts the fuel's lubricity. Fuel lubricity, required for the efficient operation of fuel delivery system, can be improved by the use of costly additive packages. The production of clean, high cetane number distillates from Fischer-Tropsch waxes has been discussed in the open literature, but the processes disclosed for preparing such distillates also leave the distillate lacking in one or more important properties, e.g., lubricity. The Fischer-Tropsch distillates disclosed, therefore, require blending with other less desirable stocks or the use of costly additives. These earlier schemes disclose hydrotreating the total Fischer-Tropsch product, including the entire 700° F.– fraction. This hydrotreating results in the elimination of oxygenates from the distillate.

By virtue of this present invention small mounts of oxygenates are retained, the resulting product having both very high octane number and high lubricity. This product is useful as a diesel fuel as such, or as a blending stock for preparing diesel fuels from other lower grade material.

SUMMARY OF THE INVENTION

In accordance with this invention, a clean distillate useful as a diesel fuel or as a diesel fuel blend stock and having a cetane number of at least about 60, preferably at least about 70, more preferably at least about 74, is produced, preferably from a Fischer-Tropsch wax and preferably derived from a cobalt or ruthenium catalyst, by separating the waxy product into a heavier fraction and a lighter fraction; the nominal separation being at about 700° F. Thus, the heavier fraction contains primarily 700° F.+, and the lighter fraction contains primarily 700° F.–.

The distillate is produced by further separating the 700° F.– fraction into at least two other fractions: (i) one of which contains primary $C_{12}$+ alcohols and (ii) one of which does not contain such alcohols. The fraction (ii) is preferably a 500° F.– fraction, more preferably a 600° F.– fraction, and still more preferably a $C_5$–500° F. fraction, or a $C_5$–600° F. fraction. This fraction (ii) and the heavier fraction are subjected to hydroisomerization in the presence of a hydroisomerization catalyst and at hydroisomerization conditions. The hydroisomerization of these fractions may occur separately or in the same reaction zone, preferably in the same zone. In any event at least a portion of the 700° F.+ material is converted to 700° F.– material. Subsequently, at least a portion and preferably all of the 700° F.– material from hydroisomerization is combined with at least a portion and preferably all of the fraction (ii) which is preferably a 500°–700° F. fraction, and more preferably a 600°–700° F. fraction, and is further preferably characterized by the absence of any hydrotreating, e.g., hydroisomerization. From the combined product a diesel fuel or diesel blending stock boiling in the range 250°–700° F. is recovered and has the properties described below.

DESCRIPTION OF PREFERRED EMBODIMENTS

Figure 1:
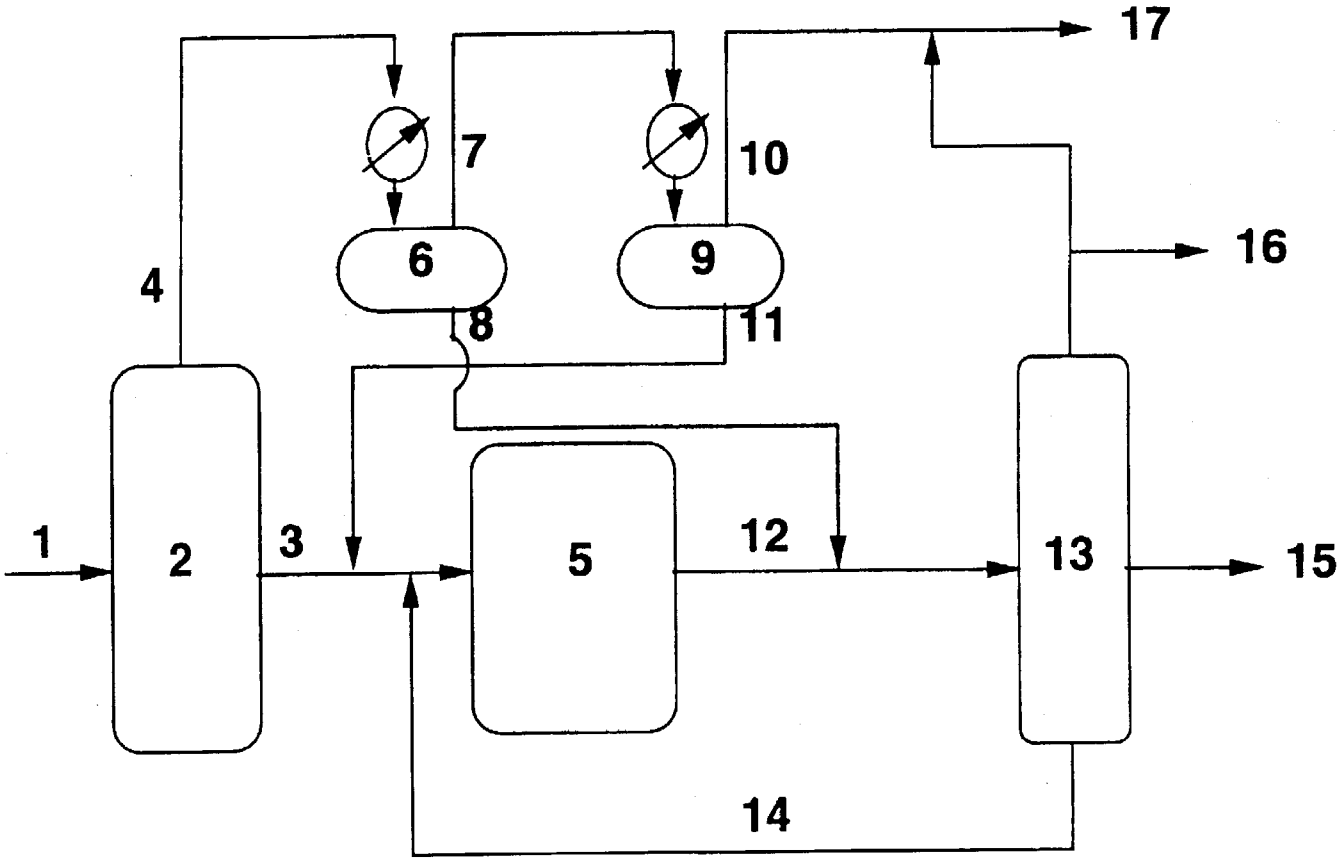
FIG. 1 is a schematic of a process in accordance with this invention.

A more detailed description of this invention may be had by referring to the drawing. Synthesis gas, hydrogen and carbon monoxide, in an appropriate ratio, contained in line 1 is fed to a Fischer-Tropsch reactor 2, preferably a slurry reactor and product is recovered in lines 3 and 4, 700° F.+ and 700° F.– respectively. The lighter fraction goes through hot separator 6 and a 500°–700° F. fraction is recovered in line 8, while a 500° F.– fraction is recovered in line 7. The 500° F.– material goes through cold separator 9 from which $C_4$-gases are recovered in line 10. A $C_5$–500° F. fraction is recovered in line 11 and is combined with the 700° F.+ fraction in line 3. At least a portion and preferably most, more preferably essentially all of the 500° F.–700° F. fraction is blended with the hydroisomerized product in line 12.

The heavier, e.g., 700° F.+ fraction, in line 3 together with the lighter, e.g., $C_5$–500° F. fraction from line 11 is sent to hydroisomerization unit 5. The reactor of the hydroisomerization unit operates at typical conditions shown in the table below:

The hydroisomerization process is well known and the table below lists some broad and preferred conditions for this step.

| Condition | Broad Range | Preferred Range |
|---|---|---|
| temperature, °F. | 300–800 | 550–750 |
| total pressure, psig | 0–2500 | 300–1200 |
| hydrogen treat rate, SCF/B | 500–5000 | 2000–4000 |
| hydrogen consumption rate, SCF/B | 50–500 | 100–300 |

While virtually any catalyst useful in hydroisomerization or selective hydrocracking may be satisfactory for this step, some catalysts perform better than others and are preferred. For example, catalysts containing a supported Group VIII noble metal, e.g., platinum or palladium, are useful as are catalysts containing one or more Group VIII base metals, e.g., nickel, cobalt, in amounts of 0.5–20 wt %, which may or may not also include a Group VI metal, e.g., molybdennm, in amounts of 1.0–20 wt %. The support for the metals can be any refractory oxide or zeolite or mixtures thereof. Preferred supports include silica, alumina, silica-alumina, silica-alumina phosphates, titania, zirconia, vanadia and other Group III, IV, VA or VI oxides, as well as Y sieves, such as ultrastable Y sieves. Preferred supports include alma and silica-alumina where the silica concentration of the bulk support is less than about 50 wt %, preferably less than about 35 wt %.

A preferred catalyst has a surface area in the range of about 200–500 $m^2$/gm, preferably 0.35 to 0.80 ml/gm, as determined by water adsorption, and a bulk density of about 0.5–1.0 g/ml.

This catalyst comprises a non-noble Group VIII metal, e.g., iron, nickel, in conjunction with a Group IB metal, e.g., copper, supported on an acidic support. The support is preferably an amorphous silica-alma where the alumina is present in mounts of less than about 30 wt. %, preferably 5–30 wt %, more preferably 10–20 wt %. Also, the support may contain small amounts, e.g., 20–30 wt %, of a binder, e.g., alma, silica, Group IVA metal oxides, and various types of clays, magnesia, etc., preferably alumina.

The preparation of amorphous silica-alma microspheres has been described in Ryland, Lloyd B., Tamele, M. W., and Wilson, J. N., Cracking Catalysts, Catalysis: volume VII, Ed. Paul H. Emmett, Reinhold Publishing Corporation, New York, 1960, pp. 5–9.

The catalyst is prepared by coimpregnating the metals from solutions onto the support, drying at 100°–150° C., and calcining in air at 200°–550° C.

The Group VIII metal is present in amounts of about 15 wt % or less, preferably 1–12 wt %, while the Group IB metal is usually present in lesser amounts, e.g., 1:2 to about 1:20 ratio respeering the Group VIII metal. A typical catalyst is shown below:

| | |
|---|---|
| Ni, wt % | 2.5–3.5 |
| Cu, wt % | 0.25–0.35 |
| $Al_2O_3$—$SiO_2$ | 65–75 |
| $Al_2O_3$ (binder) | 25–30 |
| Surface Area | 290–325 $m^2$/gm |
| Pore Volume (Hg) | 0.35–0.45 ml/gm |
| Bulk Density | 0.58–0.68 g/ml |

The 700° F.+ conversion to 700° F.– ranges from about 20–80%, preferably 20–50%, more preferably about 30–50%. During hydroisomerization, essentially all olefins and oxygen containing materials are hydrogenated.

The hydroisomerization product is recovered in line 12 into which the 500° F.–700° F. stream of line 8 is blended. The blended stream is fractionated in tower 13, from which 700° F.+ is, optionally, recycled in line 14 back to line 3, $C_5$– is recovered in line 16, and may be mixed with light gases from the cold separator 9 in line 10 to form stream 17. A clean distillate boiling in the range of 250°–700° F. is recovered in line 15. This distillate has unique properties and may be used as a diesel fuel or as a blending component for diesel fuel.

Passing the $C_5$–500° F. fraction through the hydroisomerization unit has the effect of further lowering the olefin concentration in the product streams 12 and 15, thereby further improving the oxidative stability of the product. Olefin concentration in the product is less than 0.5 wt %, preferably less than 0.1 wt %. Thus, the olefin concentration is sufficiently low as to make olefin recovery unnecessary; and further treatment of the fraction for olefins is avoided.

The separation of the 700° F.– stream into a $C_5$–500° F. stream and a 500°–700° F. stream and the hydroisomerization of $C_5$–500° F. stream leads, as mentioned, to lower olefin concentrations in the product. Additionally, however, the oxygen containing compounds in the $C_5$–500° F. have the effect of lowering the methane yield from hydroisomerization. Ideally, a hydroisomerization reaction involves little or no cracking of the Fischer-Tropsch paraffins. Ideal conditions are not often achieved and some cracking to gases, particularly $CH_4$, always accompanies this reaction. By virtue of the processing scheme disclosed herein methane yields from hydroisomerizing the 700° F.+ fraction with the $C_5$–500° F. fraction allows reductions in methane yields on the order of at least 50%, preferably at least 75%.

The diesel material recovered from the fractionator has the properties shown in the following table:

| | |
|---|---|
| paraffins | at least 95 wt %, preferably at least 96 wt %, more preferably at least 97 wt %, still more preferably at least 98 wt %, and most preferably at least 99 wt % |
| iso/normal ratio | about 0.3 to 3.0, preferably 0.7–2.0 |
| sulfur | ≦50 ppm (wt), preferably nil |
| nitrogen | ≦50 ppm (wt), preferably ≦20 ppm, more preferably nil |
| unsaturates (olefins and aromatics) | ≦0.5 wt %, preferably ≦0.1 wt % |
| oxygenates | about 0.001 to less than about 0.3 wt % oxygen, water free basis |

The iso-paraffins are normally mono-methyl branched, and since the process utilizes Fischer-Tropsch wax, the product contains nil cyclic paraffins, e.g., no cyclohexane.

The oxygenates are contained essentially, e.g., ≧95% of oxygenates, in the lighter fraction, e.g., the 700° F.– fraction.

The preferred Fischer-Tropsch process is one that utilizes a non-shifting (that is, no water gas shift capability) catalyst, such as cobalt or ruthenium or mixtures thereof, preferably cobalt, and preferably a promoted cobalt, the promoter being zirconium or rhenium, preferably rhenium. Such catalysts are well known and a preferred catalyst is described in U.S. Pat. No. 4,568,663 as well as European Patent 0 266 898.

The products of the Fischer-Tropsch process are primarily paraffinic hydrocarbons. Ruthenium produces paraffins primarily boiling in the distillate range, i.e., $C_{10}$–$C_{20}$; while cobalt catalysts generally produce more of heavier hydrocarbons, e.g., $C_{20}$+, and cobalt is a preferred Fischer-Tropsch catalytic metal.

Good diesel fuels generally have the properties of high cetane number, usually 50 or higher, preferably 60, more preferably at least about 65, or higher lubricity, oxidative stability, and physical properties compatible with diesel pipeline specifications.

The product of this invention can be used as a diesel fuel, per se, or blended with other less desirable petroleum or hydrocarbon containing feeds of about the same boiling range. When used as a blend, the product of this invention can be used in relatively minor amounts, e.g., 10% or more, for significantly improving the final blended diesel product. Although, the product of this invention will improve almost any diesel product, it is especially desirable to blend this product with refinery diesel streams of low quality. Typical streams are raw or hydrogenated catalytic or thermally cracked distillates and gas oils.

By virtue of using the Fischer-Tropsch process, the recovered distillate has essentially nil sulfur and nitrogen. These hereto-atom compounds are poisons for Fischer-Tropsch catalysts and are removed from the methane containing natural gas that is a convenient feed for the Fischer-Tropsch process. (Sulfur and nitrogen containing compounds are, in any event, in exceedingly low concentrations in natural gas. Further, the process does not make aromatics, or as usually operated, virtually no aromatics are produced. Some olefins are produced since one of the proposed pathways for the production of paraffins is through an olefinic intermediate. Nevertheless, olefin concentration is usually quite low.

Oxygenated compounds including alcohols and some acids are produced during Fischer-Tropsch processing, but in at least one well known process, oxygenates and unsaturates are completely eliminated from the product by hydrotreating. See, for example, the Shell Middle Distillate Process, Eiler, J., Posthuma, S. A., Sie, S. T., Catalysis Letters, 1990, 7, 253–270.

We have found, however, that small amounts of oxygenates, preferably alcohols, usually concentrated in the 500°–700° F. fraction provide exceptional lubricity for diesel fuels. For example, as illustrations will show a highly paraffinic diesel fuel with small amounts of oxygenates has excellent lubricity as shown by the BOCLE test (ball on cylinder lubricity evaluator). However, when the oxygenates were removed, for example, by extraction, absorption over molecular sieves, hydroprocessing, etc., to a level of less than 10 ppm wt % oxygen (water free basis) in the fraction being tested, the lubricity was quite poor.

By virtue of the processing scheme disclosed in this invention a part of the lighter, 700° F.– fraction, i.e., the 500° F.–700° F. fraction is not subjected to any hydrotreating. In the absence of hydrotreating of this fraction, the small amount of oxygenates, primarily linear alcohols, in this fraction are preserved, while oxygenates in the heavier fraction are eliminated during the hydroisomerization step. Some oxygenates contained in the $C_5$–500° F. fraction will be converted to paraffins during hydroisomerization. However, the valuable oxygen containing compounds, for lubricity purposes, most preferably $C_{12}$–$C_{18}$ primary alcohols are in the untreated 500°–700° F. fraction. Hydroisomerization also serves to increase the amount of iso paraffins in the distillate fuel and helps the fuel to meet pour point and cloud point specifications, although additives may be employed for these purposes.

The oxygen compounds that are believed to promote lubricity may be described as having a hydrogen bonding energy greater than the bonding energy of hydrocarbons (these energy measurements for various compounds are available in standard references); the greater the difference, the greater the lubricity effect. The oxygen compounds also have a lipophilic end and a hydrophilic end to allow wetting of the fuel.

Preferred oxygen compounds, primarily alcohols, have a relatively long chain, i.e., $C_{12}$+, more preferably $C_{12}$–$C_{24}$ primary linear alcohols.

While acids are oxygen containing compounds, acids are corrosive and are produced in quite small mounts during Fischer-Tropsch processing at non-shift conditions. Acids are also di-oxygenates as opposed to the preferred mono-oxygenates illustrated by the linear alcohols. Thus, ,di- or poly-oxygenates are usually undetectable by infra red measurements and are, e.g., less than about 15 wppm oxygen as oxygen.

Non-shifting Fischer-Tropsch reactions are well known to those skilled in the art and may be characterized by conditions that minimize the formation of $CO_2$ by products. These conditions can be achieved by a variety of methods, including one or more of the following: operating at relatively low CO partial pressures, that is, operating at hydrogen to CO ratios of at least about 1.7/1, preferably about 1.7/1 to about 2.5/1, more preferably at least about 1.9/1, and in the range 1.9/1 to about 2.3/1, all with an alpha of at least about 0.88, preferably at least about 0.91; temperatures of about 175°–225° C., preferably 180°–210° C.; using catalysts comprising cobalt or ruthenium as the primary Fischer-Tropsch catalysis agent.

The amount of oxygenates present, as oxygen on a water free basis is relatively small to achieve the desired lubricity, i.e., at least about 0.001 wt % oxygen (water free basis), preferably 0.001–0.3 wt % oxygen (water free basis), more preferably 0.0025–0.3 wt % oxygen (water free basis).

The following examples will serve to illustrate, but not limit this invention.

Hydrogen and carbon monoxide synthesis gas ($H_2$:CO 2.11–2.16) were converted to heavy paraffins in a slurry Fischer-Tropsch reactor. The catalyst utilized for the Fischer-Tropsch reaction was a titania supported cobalt/rhenium catalyst previously described in U.S. Pat. No. 4,568,663. The reaction conditions were 422–428° F., 287–289 psig, and a linear velocity of 12 to 17.5 cm/sec. The alpha of the Fischer-Tropsch synthesis step was 0.92. The paraffinic Fischer-Tropsch product was then isolated in three nominally different boiling streams, separated utilizing a rough flash. The three approximate boiling fractions were: 1) the $C_5$–500° F. boiling fraction, designated below as F-T Cold separator Liquids; 2) the 500°–700° F. boiling fraction designated below as F-T Hot Separator Liquids; and 3) the 700° F.+ boiling fraction designated below at F-T Reactor Wax.

EXAMPLE 1

Seventy wt % of a Hydroisomerized F-T Reactor Wax, 16.8 wt % Hydrotreated F-T Cold Separator Liquids and 13.2 wt % Hydrotreated F-T Hot Separator Liquids were combined and rigorously mixed. Diesel Fuel A was the 260°–700° F., boiling fraction of this blend, as isolated by distillation, and was prepared as follows: the hydroisomerized F-T Reactor Wax was prepared in flow through, fixed bed unit using a cobalt and molybdenum promoted amorphous silica-alma catalyst, as described in U.S. Pat. No. 5,292,989 and U.S. Pat. 5,378,348. Hydroisomerization conditions were 708° F., 750 psig $H_2$, 2500 SCF/B $H_2$, and a liquid hourly space velocity (LHSV) of 0.7–0.8. Hydroisomerization was conducted with recycle of unreacted 700° F.+ reactor wax. The Combined Feed Ratio (Fresh Feed +Recycle Feed)/Fresh Feed equaled 1.5. Hydrotreated F-T Cold and Hot Separator Liquid were prepared using a flow through fixed bed reactor and commercial massive nickel catalyst. Hydrotreating conditions were 450° F., 430 psig $H_2$, 1000 SCF/B $H_2$, and 3.0 LHSV. Fuel A is representative of a typical of a completely hydrotreated cobalt derived Fischer-Tropsch diesel fuel, well known in the art.

EXAMPLE 2

Seventy Eight wt % of a Hydroisomerized F-T Reactor Wax, 12 wt % Unhydrotreated F-T Cold Separator Liquids, and 10 wt % F-T Hot Separator Liquids were combined and mixed. Diesel Fuel B was the 250°–700° F. boiling fraction of this blend, as isolated by distillation, and was prepared as follows: the Hydroisomerized F-T Reactor Wax was prepared in flow through, fixed bed unit using a cobalt and molybdenum promoted amorphous silica-alumina catalyst, as described in U.S. Pat. No. 5,292,989 and U.S. Pat. No. 5,378,348. Hydroisomerization conditions were 690° F., 725 psig $H_2$, 2500 SCF/B $H_2$, and a liquid hourly space velocity (LHSV) of 0.6–0.7. Fuel B is a representative example of this invention.

EXAMPLE 3

Diesel Fuels C and D were prepared by distilling Fuel B into two fractions. Diesel Fuel C represents the 250° F. to 500° F. fraction of Diesel Fuel B. Diesel Fuel D represents the 500°–700° F. fraction of Diesel Fuel B.

EXAMPLE 4

100.81 grams of Diesel Fuel B was contacted with 33.11 grams of Grace Silico-aluminate zeolite: 13X, Grade 544, 812 mesh beads. Diesel Fuel E is the tiltrated liquid resulting from this treatment. This treatment effectively removes alcohols and other oxygenates from the fuel.

EXAMPLE 5

Oxygenate, dioxygenate, and alcohol composition of Diesel Fuels A, B, and E were measured using Proton Nuclear Magnetic Resonance ($^1$H-NMR), Infrared Spectroscopy (IR), and Gas Chromatography/Mass Spectrometry (GC/MS). $^1$H-NMR experiments were done using a Brucker MSL-500 Spectrometer. Quantitative data were obtained by measuring the samples, dissolved in $CDCl_3$, at ambient temperature, using a frequency of 500.13 MHz, pulse width of 2.9 s (45 degree tip angle), delay of 60 s, and 64 scans. Tetramethylsilane was used as an internal reference in each case and dioxane was used as an internal standard. Levels of primary alcohols, secondary alcohols, esters and acids were estimated directly by comparing integrals for peaks at 3.6 (2H), 3.4 (1H), 4.1 (2H) and 2.4 (2H) ppm respectively, with that of the internal standard. IR Spectroscopy was done using a Nicolet 800 spectrometer. Samples were prepared by placing them in a KBr fixed path length cell (nominally 1.0 mm) and acquisition was done by adding 4096 scans a 0.3 $cm^{-1}$resolution. Levels of dioxygenates, such as carboxylic acids and esters, were measured using the absorbance at 1720 and 1738 $cm^{-1}$, respectively. GC/MS were performed using either a Hewlett-Packard 5980/Hewlett-Packard 5970B Mass Selective Detector Combination (MSD) or Kratos Model MS-890 GC/MS. Selected ion monitoring of m/z 31 ($CH_3O^+$) was used to quantify the primary alcohols. An external standard was made by weighing $C_2$–$C_{14}$, $C_{16}$ and $C_{18}$ primary alcohols into mixture of $C_8$–$C_{16}$ normal paraffins. Olefins were determined using Bromine Index, as described in ASTM D 2710. Results from these analyses are presented in Table 1. Diesel Fuel B which contains the unhydrotreated hot and cold separator liquids contains a significant mount of oxygenates as linear, primary alcohols. A significant fraction of these are the important $C_{12}$–$C_{18}$ primary alcohols. It is these alcohols that impart superior performance in diesel lubricity. Hydrotreating (Diesel Fuel A) is extremely effective at removing essentially all of the oxygenates and olefins. Mole sieve treatment (Diesel Fuel E) also is effective at removing the alcohol contaminants without the use of process hydrogen. None of these fuels contain significant levels of dioxygenates, such as carboxylic acids or esters.

TABLE 1

Oxygenate, and dioxygenate (carboxylic acid, esters) composition of All Hydrotreated Diesel Fuel (Diesel Fuel A), Partially Hydrotreated Diesel Fuel (Diesel Fuel B), and the Mole Sieve Treated, Partially Hydrotreated Diesel Fuel (Diesel Fuel E)

| | Diesel Fuel A | Diesel Fuel B | Diesel Fuel E |
|---|---|---|---|
| wppm Oxygen in dioxygenates, (carboxylic acids, esters) (IR) | None Detected | None Detected | None Detected |
| wppm Oxygen in $C_5$–$C_{18}$ primary alochols ($^1$H NMR) | None Detected | 640 ppm | None Detected |
| wppm Oxygen in $C_5$–$C_{18}$ primary alcohols (GC/MS) | 5.3 | 824 ppm | None Detected |
| wppm Oxygen in $C_{12}$–$C_{18}$ primary alcohols (GC/MS) | 3.3 | 195 ppm | None Detected |
| Total Olefins - mmol/g (Bromine Index, ASTM D 2710) | 0.004 | 0.78 | — |

TABLE 1-continued

EXAMPLE 6

Diesel Fuels A–E were all tested using a standard Ball on Cylinder Lubricity Evaluation (BOCLE), further described as Lacey, P. I. "The U.S. Army Scuffing Load Wear Test", Jan. 1, 1994. This test is based on ASTM D 5001. Results are reported in Table 2 as percents of Reference Fuel 2, described in Lacey.

TABLE 2

BOCLE results for Fuels A–E. Results reported as percents of Reference Fuel 2 as described in

| Diesel Fuel | % Reference Fuel 2 |
|---|---|
| A | 42.1 |
| B | 88.9 |
| C | 44.7 |
| D | 94.7 |
| E | 30.6 |

The completely hydrotreated Diesel Fuel A, exhibits very low lubricity typical of an all paraffin diesel fuel. Diesel Fuel B, which contains a high level of oxygenates as linear, $C_5$–$C_{24}$ primary alcohols, exhibits significantly superior lubricity properties. Diesel Fuel E was prepared by separating the oxygenates away from Diesel Fuel B through adsorption by 13X molecular sieves. Diesel Fuel E exhibits very poor lubricity indicating the linear $C_5$–$C_{24}$ primary alcohols are responsible for the high lubricity of Diesel Fuel B. Diesel Fuels C and D represent the 250°–500° F. and the 500°–700° F. boiling fractions of Diesel Fuel B, respectively. Diesel Fuel C contains the linear $C_5$–$C_{11}$ primary alcohols that boil below 500° F., and Diesel Fuel D contains the $C_{12}$–$C_{24}$ primary alcohols that boil between 500°–700° F. Diesel Fuel D exhibits superior lubricity properties compared to Diesel Fuel C, and is in fact superior in performance to Diesel Fuel B from which it is derived. This clearly indicates that the $C_{12}$–$C_{24}$ primary alcohols that boil between 500°–700° F. are important to producing a high lubricity saturated fuel. The fact that Diesel Fuel B exhibits lower lubricity than Diesel Fuel D also indicates that the light oxygenates contained in 250°–500° F. fraction of Diesel Fuel B adversely limit the beneficial impact of the $C_{12}$–$C_{24}$ primary alcohols, contained in the 500°–700° F. of Diesel Fuel B. It is therefore desirable produce a Diesel Fuel with a minimum mount of the undesirable $C_5$–$C_{11}$ light primary alcohols, but with maximum mounts of the beneficial $C_{12}$–$C_{24}$ primary alcohols. This can be accomplished by selectively hydrotreating the 250°–500° F. boiling cold separator liquids, and not the 500°–700° F. boiling hot separator liquids.

EXAMPLE 7

Figure 2:
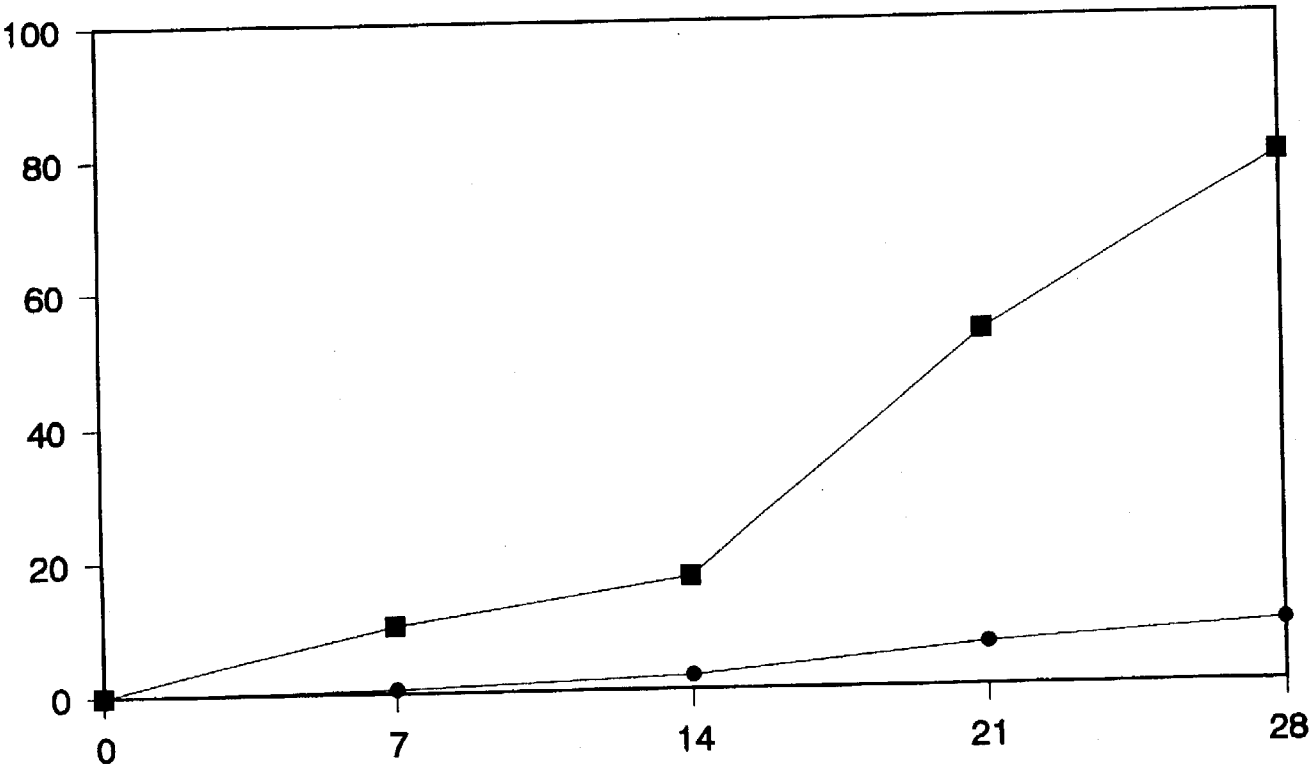
FIG. 2 is a plot of peroxide number (ordinate), test time in days (abscissa) for the 250°–500° F. fraction (upper curve) and a 500°–700° F. fraction (lower curve).

The oxidative stability of Diesel Fuels C and D were tested by observing the buildup of hydroperoxides over time. Diesel Fuel C and D represent the 250°–500° F. and 500°–700° F. boiling fractions of Diesel Fuel B, respectively. This test is fully described in ASTM D3703. More stable fuels will exhibit a slower rate of increase in the titrimetric hydroperoxide number. The peroxide level of each sample is determined by iodometric titration, at the start and at periodic intervals during the test. Due to the inherent stability both of these fuels; both were aged first at 25° C. (room temperature) for 7 weeks before starting the peroxide. FIG. 2 shows the buildup over time for both Diesel Fuels C and D. It can be seen clearly that the 250°–500° F. boiling Diesel Fuel C is much less stable than the 500°–700° F. boiling Diesel Fuel D. The relative instability of Diesel Fuel C results from the fact that it contains greater than 90% of the olefms found in Diesel Fuel B. Olefms are well known in the art to cause oxidative instability. This saturation of these relatively unstable light olefms is an additional reason for hydrotreating and 250°–500° F. cold separator liquids.

What is claimed is:

1. A distillate fraction useful as a fuel heavier than gasoline or as a blending component for a distillate fuel comprising: a 250°–700° F. distillate fraction derived from a Fischer-Tropsch catalytic process and containing at least 95 wt % paraffins with an iso to normal ratio of about 0.3 to 3.0, ≦50 ppm (wt) each of sulfur and nitrogen less than about 0.5 wt % unsaturates, about 0.001 to less than 0.3 wt % linear $C_{12}$–$C_{24}$ primary alcohol oxygenate, as oxygen on a water free basis.

2. The fraction of claim 1 characterized by a cetane number of at least 70.

3. A process for producing a distillate fuel heavier than gasoline comprising:

(a) separating the waxy product of a Fischer-Tropsch process into a heavier fraction containing 700°+ and a lighter fraction containing 700°;

(b) further separating the lighter fraction into at least two fractions, (i) at least one fraction containing primary $C_{12}$–$C_{24}$ alcohols and (ii) one or more other fractions;

(c) hydroisomerizing at least a portion of the heavier fraction of step (a) and at least a portion of the (b) (ii) fractions at hydroisomerization conditions and recovering a 700° F.– fraction;

(d) blending at least a portion of the fraction (b) (i) with at least a portion of of the 700° F.– fractions of step (c) and recovering a product boiling in the range 250°–700° F.–, containing 0.001 to 0.3 wt % $C_{12}$–$C_{24}$ primary alcohol oxygenate, as oxygen on a water free basis.

4. The product of claim 3.

5. The process of claim 3 wherein the fraction (b) (i) is characterized by the absence of hydrotreating.

6. The process of claim 3 wherein the Tropsch process is characterized by non-shifting conditions.

7. The process of claim 3 characterized in that the fraction b (ii) is 500° F.–.

8. The process of claim 3 characterized in that the fraction b (ii) is 600° F.–.

9. The fraction of claim 1 characterized by a cetane number of at least 60.

10. The process of claim 3 in which the recovered product is characterized by a cetane number of at least 60.

11. The process of claim 3 in which the recovered product is characterized by a cetane number of at least 70.

* * * * *

UNITED STATES PATENT AND TRADEMARK OFFICE

CERTIFICATE OF CORRECTION

PATENT NO. : 5,689,031

DATED : November 18, 1997

INVENTOR(S) : Paul J. Berlowitz

It is certified that error appears in the above-identified patent and that said Letters Patent is hereby corrected as shown below:

claim 3, col. 10, line 2: delete "700°+" and replace with --700°F+--;

line 3, delete "700°" and replace with --700°F--.

Signed and Sealed this

Fifteenth Day of September, 1998

*Attest:*

*Attesting Officer*

BRUCE LEHMAN

*Commissioner of Patents and Trademarks*